United States Patent [19]

Ferrier

[11] 4,037,612

[45] July 26, 1977

[54] WAVE ROD SYSTEM

[76] Inventor: Vernon Dale Ferrier, 5241 Pleasant Ave., Fairfield, Ohio 45014

[21] Appl. No.: 688,682

[22] Filed: May 21, 1976

[51] Int. Cl.[2] ..... A45D 2/00

[52] U.S. Cl. ..... 132/31 R

[58] Field of Search ..... 132/31 R, 38, 40, 41–42

[56] References Cited

U.S. PATENT DOCUMENTS

| | | | |
|---|---|---|---|
| 2,938,523 | 5/1960 | Solomon | 132/42 R |
| 3,123,079 | 3/1964 | Buesgen | 132/40 |
| 3,200,824 | 8/1965 | Coloccia | 132/40 |
| 3,461,884 | 8/1969 | Augusta | 132/42 R |

*Primary Examiner*—G.E. McNeill

*Attorney, Agent, or Firm*—Thomas M. Farrell

[57] ABSTRACT

An improved wave rod system for curling hair, wherein a spool-like rod is provided with a tapered splined bore in each end, and a locking arm having a transverse tapered splined stub, is plugged into the tapered bore of the rod after a hair tress is wound on the rod. The locking arm counteracts the tendency of the rod to unroll, by providing a countertorque arm which, in the case of a single rod, bears against the scalp of the user to prevent the rod from rotating about its own axis. In the case of multiple rollers, slidable tapered stubs are provided which are movable on the arm, and engageable with similar rod bores at varied rod center distances.

18 Claims, 7 Drawing Figures

WAVE ROD SYSTEM

BACKGROUND OF THE INVENTION

In the field of hair care, it is frequently necessary to employ a curling rod or "wave rod" in the practice of providing a "permanent wave" to a person's hair. Prior art devices generally have certain features in common with one another. Specifically, when it is necessary to roll a tress of hair to a set position, the hair is generally wound about a rod or spool to a point where the rod is proximal to the scalp, at which time a clamp is impressed on the wound tress thereby binding the hair to the rod so that the rod cannot unroll and otherwise distort the wound tress.

One most common prior art device is a spool having an elastic band attached to one end which may hang free from the spool, and a cylindrical plug is attached to the distal end of the elastic band. An axial hole is provided through the spool and, after a tress has been wound on the spool, in croquignole fashion, that is, wound on itself, the elastic band is drawn axially across the wound tress and the plug is inserted in the bore of the spool at the end of the spool opposite the attached band.

The elastic band which is now tensioned across the wound tress, creates a groove along the hairs, conforming to the band, and the groove may become set in the hair, causing an undesired wave form and other potential deleterious effects. For example, the comfort of the wearer of the prior art wave rod may be affected by a "pulling" on the individual hairs by the impressed elastic band. Further, in one common method of permanent waving, a softener is applied to the hair which has been then wound on the wave rod and thus the groove is easily impressed on the softened hairs. At a still later time, it may become necessary to apply a chemical to the curled hair tresses which will reharden the individual hair shafts and reconstitute them to their normal texture. At the time of rehardening, the groove is more permanently set in the curled hair, which may give rise to a stress point in the hair, most often near the scalp. The occurrence of the stress points on the hairs may often cause consequential breakage of the hairs at the stress points at various times after curling. The damaged hairs are subject to stress and strain of combing, brushing, dressing and washing, which accentuate the hair damage.

A novel prior art device was developed to combat the effects of the above-discussed prior art design, that is, to remove the clip or banding means which are generally drawn across the curled tress. U.S. Pat. No. 2,852,029 sets forth an attempt at solving the problem of the prior art devices by means of providing a tubular spool having nubs about an aperture in each end, and having an elastic band drawn through a central bore in the spool, the ends of the band being attached to two pivotable levers, respectively. It is envisioned that when rolling a hair tress, the levers will be colinear with the axis of the spool until such point as it is desired to lock the curl. At such time, the levers are slipped to a position 90° to the central axis of the spool, at which time the levers engage the locking lugs at the spool end, creating an arm about the spool end. The arm is designed to be impressed against the scalp of the user thereby providing a countertorque arm to prevent the spool from unwinding.

Certain difficulties are inherent in the design of the aforementioned patent. For example, the unit is composed of multiple pieces and is somewhat difficult to assemble. Furthermore, when the levers extend axially from the spool ends, it is most difficult and cumbersome for the person winding the hair to grasp the ends of the spool while winding the hair and yet provide for clearance for the levers to extend into the palm areas of the hands. Further, when applying the locking levers, it is difficult to grasp the spool and move each of the two levers at the same time. In addition, the levers possibly will not reach a common reacting surface since the scalp may be irregularly shaped, or the levers may not be parallel to one another, and hence only one lever may bear against the scalp while the other lever is jutting forth into space, possibly interfering with adjacent curling rods.

Applicant has obviated the difficulties inherent in the prior art devices by his novel design.

It is therefore an object of the present invention to provide a wave rod which will not rely on locking means impressed on the wound tress to prevent subsequent unrolling of the wave rod.

Another object of the present invention is to provide a low cost, easy to use, wave rod system.

A still further object of the present invention is to provide a wave rod system wherein the rods may be linked to one another to prevent subsequent unrolling of the wave rods, while not relying on locking means impressed on the hair to prevent such unrolling.

Still another object of the present invention is to provide a wave rod system wherein the wave rods may be linked to one another and arrayed in such fashion as to give greater flexibility in designed styling.

Still another object of the present invention is to provide a wave rod system whereby varying sizes of wave rods may employ a common locking member freely interchanged with said wave rods, and capable of locking varied wave rods together.

SUMMARY OF THE INVENTION

A wave rod system wherein the deleterious effects caused by impressing a locking member across the tresses of a wound wave rod, are obviated by a novel wave rod, spool like in appearance, having an axial hole therethrough. Each end of the axial hole is provided with a tapered splined counterbore which is capable of receiving a cooperating male member. A locking arm, comprised of a bar having a rectangular cross-section is fitted with a transverse tapered splined stub attached to the arm at one end, and the arm is relatively flexible in a direction parallel to the stub axis, but relatively stiff in the direction transverse to the stub axis.

When a tress has been wound on the spool-like rod, to a point where the rod is proximal to the scalp, the stub of the arm is plugged into the cooperating female bore in the spool, thus establishing a locking arm in engagement with the spool. The arm end which is distal from the stub may bear against the scalp of the user thus creating a countertorque arm to resist any tendency of the curl to unwind, as the rod is prevented from rotating about its own axis.

For multiple rod applications, slidable tapered splined stubs, having a slot through the base end transverse to the central axis of the slidable stub, are provided where the slot will bear in close fitting relationship on the arm cross-section. Thus, the slidable tapered splined stubs may be slid back and forth on the arm to a desired point where they may be plugged into a similar wave rod having a cooperating counterbore. In this fashion, it is possible to obtain a close packing density of small diameter rods having a common locking arm and counterbore, as the slidable stubs may be "ganged" on a common arm.

For other applications involving the use of multiple wave rods, the locking arm may be fitted with one slidable stub and, after the locking arm is engaged with a first wave rod, the slidable stub is engaged with a second wave rod, to secure a third wave rod, a second locking arm having a slidable stub thereon may be engaged with the opposite end of the second wave rod and the slidable stub may be thereafter engaged with the end of the third wave rod. In this manner, therefore, adjacent wave rods may be "linked" together at alternate ends thereby establishing a linkable wave rod system wherein the rods are secured from rotation about their respective axes and the unrolling of curled tresses is thereby prevented.

The transverse fixed stub of the locking arm is provided with a coaxial tapered bore in the base end of the conical stub so that, as an alternative method of linking rollers together, adjacent rollers may be linked from a common side by "plugging" a locking arm into the fixed stub of a previously applied locking arm, thereby permitting greater flexibility in applying the arms and wave rods.

DESCRIPTION OF THE PREFERRED EMBODIMENT

Figure 2:
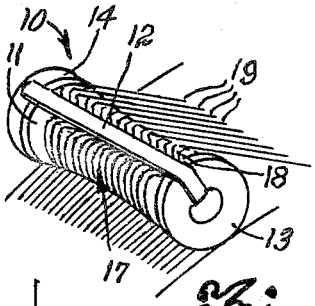
FIG. 2 is a perspective view, depicting a tress which has been wound and clamped on a prior art wave rod.
Figure 1:
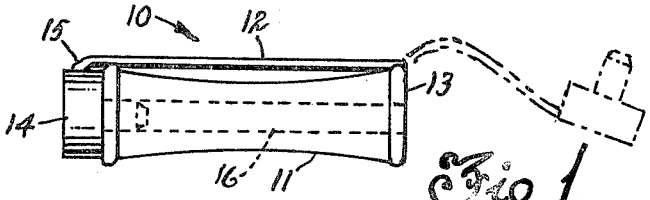
Fig. 1 PRIOR ART
FIG. 1 is an elevational view showing a prior art wave rod assembly.

Turning now to the drawings and particularly to FIGS. 1 and 2 thereof, there is shown a prior art device 10. FIG. 1 depicts the prior art device 10 as being an generally-cylindrical rod, or spool 11, having an elastic band 12 attached to one end 13 which may hang free from the spool 11 and a cylindrical locking plug 14 is attached to the distal end 15 of the elastic band 12. An axial hole 16 is provided through the spool 11 and, after a tress has been wound on the spool 11, the elastic band 12 is drawn axially across the the length of the spool 11 and the plug 14 is inserted in the hole 16 at the end of the spool opposite the end 13 of attachment of the band 12. The view in FIG. 2 is a perspective view illustrating the spool 11 of FIG. 1 having a wound tress 17 thereon and further depicting that after the elastic band 12 has been drawn axially across the spool 11 and locked as described, the elastic band 12 creats a groove 18 along the hairs 19 of the wound tress 17 conforming to the band 12, and the groove 18 may cause an undesired wave form and other potentially deleterious affects.

Figure 3:
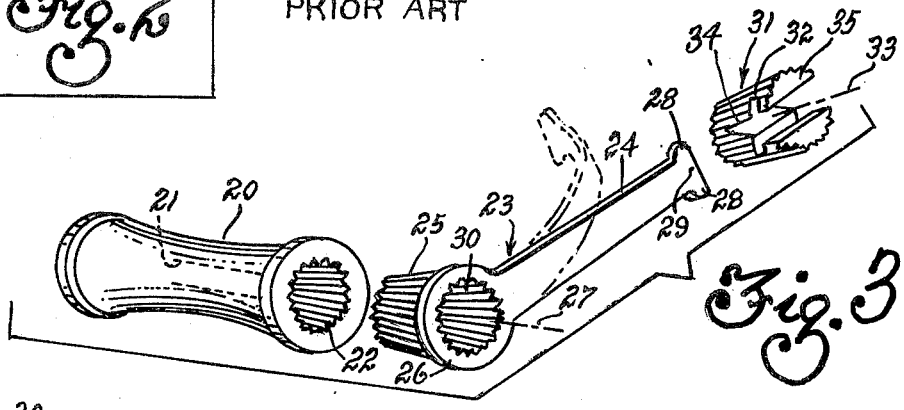
FIG. 3 is an exploded view depicting a wave rod, locking arm, and slidable stub of the present invention.

FIG. 3 is a perspective view of the basic elements of the present invention, wherein a rod, or spool 20, is provided which is generally cylindrical in shape and having an axial hole 21 therethrough. Each end of the axial hole 21 is provided with a tapered splined counterbore 22 which is capable of receiving a cooperating male number.

A locking arm 23 is provided, having a bar 24 of generally rectangular cross-section. A tapered splined stub 25, having the general shape of a truncated cone, is fixed transversely to one end 26 of the arm 23, so that the arm 23 is relatively flexible in a direction parallel to the stub axis 27, but the arm 23 is relatively stiff in a direction transverse to the stub axis 27. The arm 23 has a uniform width and thickness extending from the base of the conical stub 25, and a pair of lugs 28 are provided on the arm 23 at the end 29 distal to the stub 25. The conical stub 25 is provided with a coaxial, concentric, tapered splined counterbore 30 substantially identical to the splined counterbore 22 in the spool 20. The tapered splined counterbore 30 has its conical base at the arm end 26, as does the stub 25.

A third element, useful for multiple rod applications, is a slidable, tapered, splined, stub 31 of the general shape of a truncated cone, and the slidable 31 stub is provided with a through-slot 32 transverse to the slidable stub axis 33, wherein the slot 32 is of a corresponding cross-section to that of the bar 24. Further, an axial slot 34 is provided in the base end 35 of the stub 31, so that the transverse slot 32 may grip on the bar 24 as external force may be applied to the stub 31.

Figure 4:
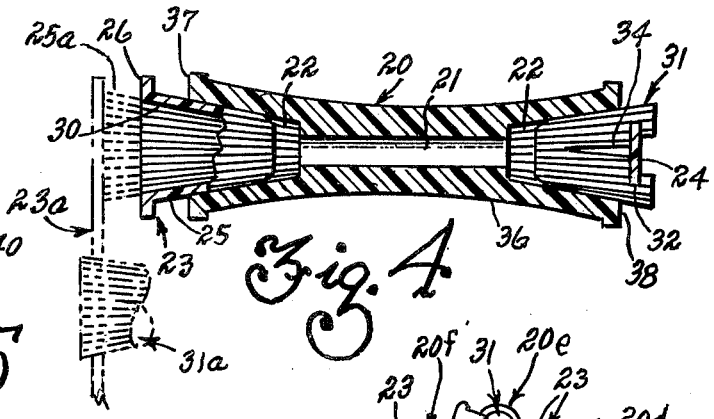
FIG. 4 is an elevation section through the axis of a wave rod having locking arms and stubs in engagement therewith.

The section shown in FIG. 4 is an axial cross-section through the spool 20 of FIG. 3 depicting the axial hole 21 and the tapered splined counterbores 22 in each end. The external surface 36 of the spool 20 is illustrated for example only and does not form a part of the invention. Rather, the invention may be used with various shapes, contours and designs of exterior surfaces of wave rods.

One end 37 of the spool 20 is shown with the stub 25 of a locking arm 23 engaging the tapered counterbore 22 and, similarly a second stub **25*a* of a second locking arm 23*a* is shown engaging the coaxial bore 30 of the stub 25. The other end 38 of the spool is shown with a slidable stub 31 engaging the tapered bore 22 and, as the slidable stub 31 is inserted axially into the bore 22 the axial slot 34 tends to close, causing the transverse slot 32 to grip snugly on the cross-section of the locking arm bar 24 shown. A second slidable stub 31*a* is shown in phantom on the second arm 23*a***.

The stubs 25, 31, are held in the bores 22 by a combination of interference taper fits and friction as axial retention means. However, other suitable retention means may be utilized, such as a detent device, for example.

Figure 5:
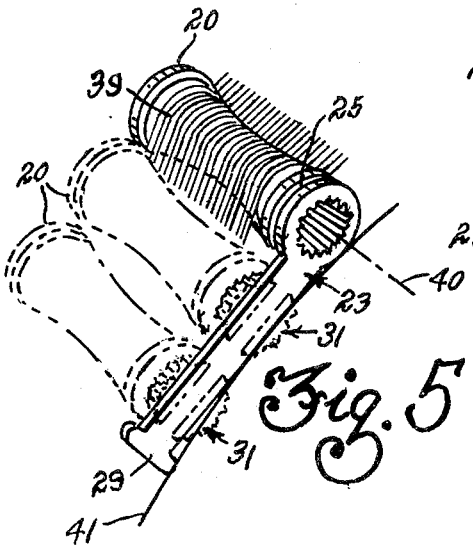
FIG. 5 is a perspective view of a tress-wound wave rod secured by a locking arm.

The perspective view of FIG. 5 depicts a spool 20 wound with a hair tress 39 in croquignole fashion; that is, wound on itself, and the spool 20 must rotate about its own axis 40 to roll or unroll the hair tress 39. When viewed along the axis 40 as shown in FIG. 5, the spool 20 must first be wound in a clockwise direction to wind the tress 39. Therefore, to unroll, the spool 20 must rotate about its own axis 40 in a counterclockwise direction. To prevent the unrolling of a single spool 20, a splined fixed 25 stub of a locking arm 23 is inserted into the end of the spool 20 after winding, and the distal end 29 of the arm 23 may bear against the scalp 41 of the user thus creating a countertorque to resist the tendency of the tress 39 to unwind. When using a series of spools 20, which are relatively small in diameter, it may be desired to gang a plurality of slidable stubs 31 on a common locking arm 23, wherein the stubs 31 engage the spools 20. In this fashion, a high density packing of spools may be obtained.

Figure 6:
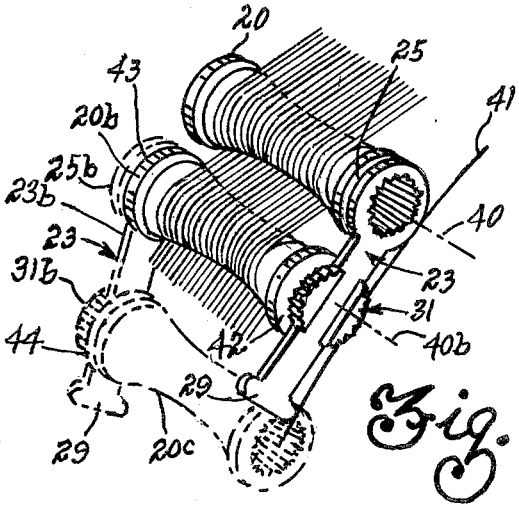
FIG. 6 is a perspective view of multiple tress-wound rollers adjacent to one another, locked from alternate rod ends.

When a series of relatively large diameter spools 20 are applied as in FIG. 6, it may be desirable to insert the splined fixed stub 25 of a locking arm 23 into the end of a first tress-wound spool 20, and a slidable stub 31 may be carried on the arm 23 and engaged with the end 42 of a second tress-wound spool **20*b*. Thereafter, as a third spool 20*c* may be used a second fixed stub 25*b* may be engaged with the opposite end 43 of the second spool 20*b* and a slidable stub 31*b* carried on the second arm 23*b* may be engaged with the end 44 of the third spool 20*c*. In this manner, therefore, it is seen that the spools 20, 20*b*, 20*c* may be "linked" together in serial, "train" fashion by alternate ends. It may be readily appreciated that when a fixed stub 25 and a slidable stub 31 are engaged in their respective spools 20, 20*b*, that the spools 20, 20*b* are prevented from rotating about their respective axes 40, 40*b* without the need for the arm end 29 to bear against the scalp 41** of the user.

Figure 7:
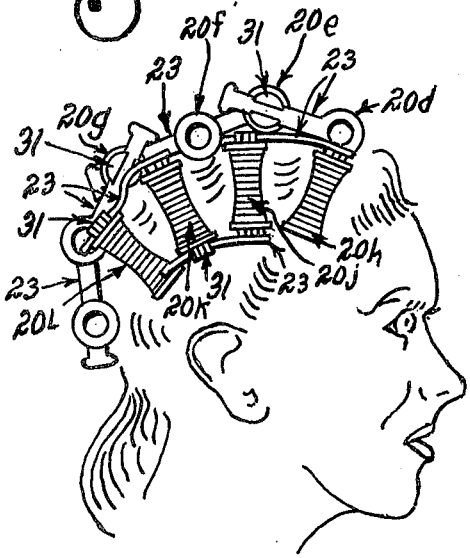
FIG. 7 is a side elevation of a user's head, employing multiple linked wave rods in varied design patterns.

The side elevation of a user depicting various modes of application of the within invention is shown in FIG. 7, wherein a first pair of spools **20*d,e* are linked in the fashion depicted in FIG. 6; that is, two discrete spools linked from the same end by an arm 23 and a slidable stub 31. Further depicted is a plurality of rollers 20*e,f,g* linked from a common side with multiple slidable stubs 31 as illustrated FIG. 5. Thus, the rollers 20*d,e,f,g***, etc. are linked together in serial fashion.

A plurality of non-parallel rollers **20*h,j,k,l* are shown linked by the locking arms 23 and slidable stubs 31**, wherein it may be readily appreciated that the transverse bendability of the arm is readily adaptable to the non-parallel pattern. In this manner, therefore, varied center distances may be accomodated and curved arrays of spools may be employed to create intricate, unique patterns for hair styling.

It should be understood that the embodiment of the instant invention described herein is illustrative only, and that this invention includes all modifications and equivalents which fall within the scope of the appended claims.

What is claimed is:

1. An improved wave rod system, comprising in combination:

a. a spool;
b. a locking arm;
c. a bore in one of said spool and locking arm;
d. a stub affixed to the other of said spool and locking arm and adapted to be lockingly received in said bore;
e. means to couple said bore and said stub so as to prevent relative rotation between said spool and said arm; and
f. means to axially retain said stub in said bore.

2. The wave rod system of claim 1, wherein said spool is generally cylindrical in shape and said bore is coaxial therewith.

3. The wave rod system of claim 1, wherein said means to couple comprises tooth means on the surface of one of said stub and said bore, and the other of said stub and said bore is drivingly received with said tooth means.

4. The wave rod system of claim 2, wherein said stub is of a truncated conical shape, affixed basewise to one end of said arm, with its apex extending transversely away from said arm.

5. The wave rod system of claim 1, wherein said means to retain comprises a diametral interference fit of said stub in said bore.

6. A wave rod system, comprising in combination:

a. a spool;
b. a bore in each end of said spool;
c. a locking arm, having a first stub affixed to, and extending transversely from, one end of said arm;
d. a second stub parallel to said first stub, wherein said second stub is slidable on said arm and rotatably fixed relative to said arm, so as to vary the center distance between said first and said second stub;
e. means to couple said bore and one of said first and second stubs to one another so as to prevent relative rotation between said stub and said bore;
f. means to axially retain said stubs in said bores; and
g. means to couple the other of said stubs to an additional, optional spool.

7. An improved hair roller, comprising in combination:

a. a spool, windable about an axis;
b. a pair of like bores, each received in an end of said spool, coaxial therewith;
c. a locking arm, having a first truncated conical stub affixed basewise to said arm with its apex extending transversely from one end of said arm;
d. tooth means to couple one of said bores and said stub to one another so as to prevent relative rotation between said arm and said spool; and
e. means to axially retain said stub in said bore.

8. The wave rod system of claim 7, further comprising a second truncated conical stub slidably received on said arm with its axis parallel to said first stub, wherein said second stub is secured from relative rotation with said arm, having tooth means provided to couple said second stub to a second spool, and means to axially retain said stub in said bore.

9. The wave rod system of claim 8, wherein said means to axially retain comprises an interference fit of said stub in said bore.

10. In a wave rod system, a method applying a variety of wave rod spools to a hair tress emanating from a scalp, comprising:

a. selecting a spool from the variety of spools;
b. winding a hair tress on said spool to a wound position proximal to the scalp;
c. engaging said spool with one end of a separate common locking arm, wherein the longitudinal axis of said arm is transverse to the wind axis;
d. permitting the other end of said arm to bear against the scalp, preventing rotation of said spool about said wind axis.

11. In a wave rod system, a method of applying a plurality of wave rod spools to hair tresses emanating from a scalp, comprising:

a. winding a plurality of discrete hair tresses on a like plurality of spools to a wound position proximal to the scalp;
b. engaging a first spool in locked relationship with one end of a locking arm, wherein the longitudinal axis of said arm is transverse to the wind axis;
c. engaging a second spool in locked relationship with a locking element adapted to said locking arm, so as to link said spools together in spaced relative relationship preventing rotation of said spools about their respective wind axes, wherein said locking arm does not engage a wound tress.

12. The method of claim 11, further comprising:

d. adapting a plurality of discrete locking elements to said arm in tandem;

e. engaging an additional plurality of tress-wound spools with said locking elements so as to prevent rotation of said additional spools about their respective wind axes.

13. The method of claim 11, further comprising:

d. successively engaging additional tress-wound spools by engaging said spools with locking arms at alternate spool ends.

14. The method of claim 11, further comprising:

d. engaging additional tress-wound spools at their ends with locking arms linked in tandem.

15. The method of claim 11, wherein step (a) further includes winding said spools into a non-parallel spool array.

16. The system of claim 6, wherein said first stub is affixed rotationally relative to said arm and further wherein said means to couple the other of said stubs includes an engagement of said other stub with another locking arm.

17. A wave rod system comprising the following in combination:

a. a plurality of windable spools having spool ends linkable by a substantially non-tress-contacting countertorque arm operable to substantially control and prevent unwinding of a wound hair tress.

18. The system of claim 17, wherein said arm is relatively stiff in a counter-torque direction, yet relatively flexible in a direction transverse to said counter-torque direction, said arm being operable to link said spools in a non-parallel spool array while substantially controlling and preventing unwinding of a wound hair tress.

* * * * *